US012766359B2

(12) United States Patent
Pond et al.

(10) Patent No.: US 12,766,359 B2
(45) Date of Patent: Oct. 20, 2026

(54) TREADMILL HAVING A CUSHIONED DECK

(71) Applicant: Peloton Interactive, Inc., New York, NY (US)

(72) Inventors: Dee Pond, Bothell, WA (US); Harrison King, Bothell, WA (US); Andrea Fox, Kenmore, WA (US)

(73) Assignee: Peloton Interactive, Inc., New York, NY (US)

( * ) Notice: Subject to any disclaimer, the term of this patent is extended or adjusted under 35 U.S.C. 154(b) by 115 days.

(21) Appl. No.: 18/759,017

(22) Filed: Jun. 28, 2024

(65) Prior Publication Data

US 2025/0001244 A1 Jan. 2, 2025

Related U.S. Application Data

(60) Provisional application No. 63/511,327, filed on Jun. 30, 2023.

(51) Int. Cl.
*A63B 22/02* (2006.01)

(52) U.S. Cl.
CPC ..... *A63B 22/0214* (2015.10)

(58) Field of Classification Search
CPC ..... A63B 22/0214; A63B 22/0285; A63B 22/0207; A63B 22/02
See application file for complete search history.

(56) References Cited

U.S. PATENT DOCUMENTS

| | | | | |
|---|---|---|---|---|
| 8,096,925 | B2 * | 1/2012 | Radding | B32B 38/0036 474/271 |
| 2003/0040405 | A1 * | 2/2003 | Watterson | A63B 71/0054 482/51 |
| 2006/0205568 | A1 * | 9/2006 | Huang | A63B 22/0207 482/54 |
| 2012/0021875 | A1 * | 1/2012 | Karl | A63B 22/0285 482/54 |
| 2018/0361194 | A1 * | 12/2018 | Corbalis | A63B 22/0221 |
| 2022/0062698 | A1 * | 3/2022 | Tsai | A63B 22/0285 |
| 2023/0310927 | A1 * | 10/2023 | Ota | A63B 22/0285 482/8 |

FOREIGN PATENT DOCUMENTS

| | | | | |
|---|---|---|---|---|
| CN | 216915135 U | * | 7/2022 | |
| KR | 20230084755 A | * | 6/2023 | A63B 22/0207 |
| TW | 202110508 A | * | 3/2021 | A63B 22/02 |

* cited by examiner

*Primary Examiner* — Andrew M Kobylarz
(74) *Attorney, Agent, or Firm* — AMPACC Law Group, PLLC

(57) ABSTRACT

A treadmill or exercise machine that incorporates various layers under a moving surface to provide cushioning or impact resilience for a user running/walking on the moving surface of the treadmill or exercise machine is described. In some embodiments, a deck of the treadmill can include or incorporate a cushioned or cushioning layer disposed on the deck, along with a thermal layer and a wear layer. In some cases, the thermal layer is disposed on a top surface of the cushioning layer, and the wear layer is disposed on the thermal layer (e.g., between the thermal layer and the moving surface).

16 Claims, 7 Drawing Sheets

TREADMILL HAVING A CUSHIONED DECK

CROSS REFERENCE TO RELATED APPLICATIONS

This application claims priority to U.S. Provisional Patent Application No. 63/511,327, filed on Jun. 30, 2023, entitled TREADMILL HAVING A CUSHIONED DECK, which is hereby incorporated by reference in its entirety.

BACKGROUND

People perform various exercise activities on exercise machines, often within an indoor environment, such as their home, a gym or fitness club, a training facility, and so on. For example, people run on a treadmill or other exercise machine having a moving surface controlled by a motor.

The moving surface, or surface upon which a person walks or runs, moves over or around a deck or other supporting assembly. The moving surface can be a belt-based surface, a slat-based surface, or other type of surface that moves around the deck, enabling a person (e.g., a runner) to walk, jog, and/or run at different speeds or inclines.

BRIEF DESCRIPTION OF THE DRAWINGS

Embodiments of the present technology will be described and explained through the use of the accompanying drawings.

Figure 1:
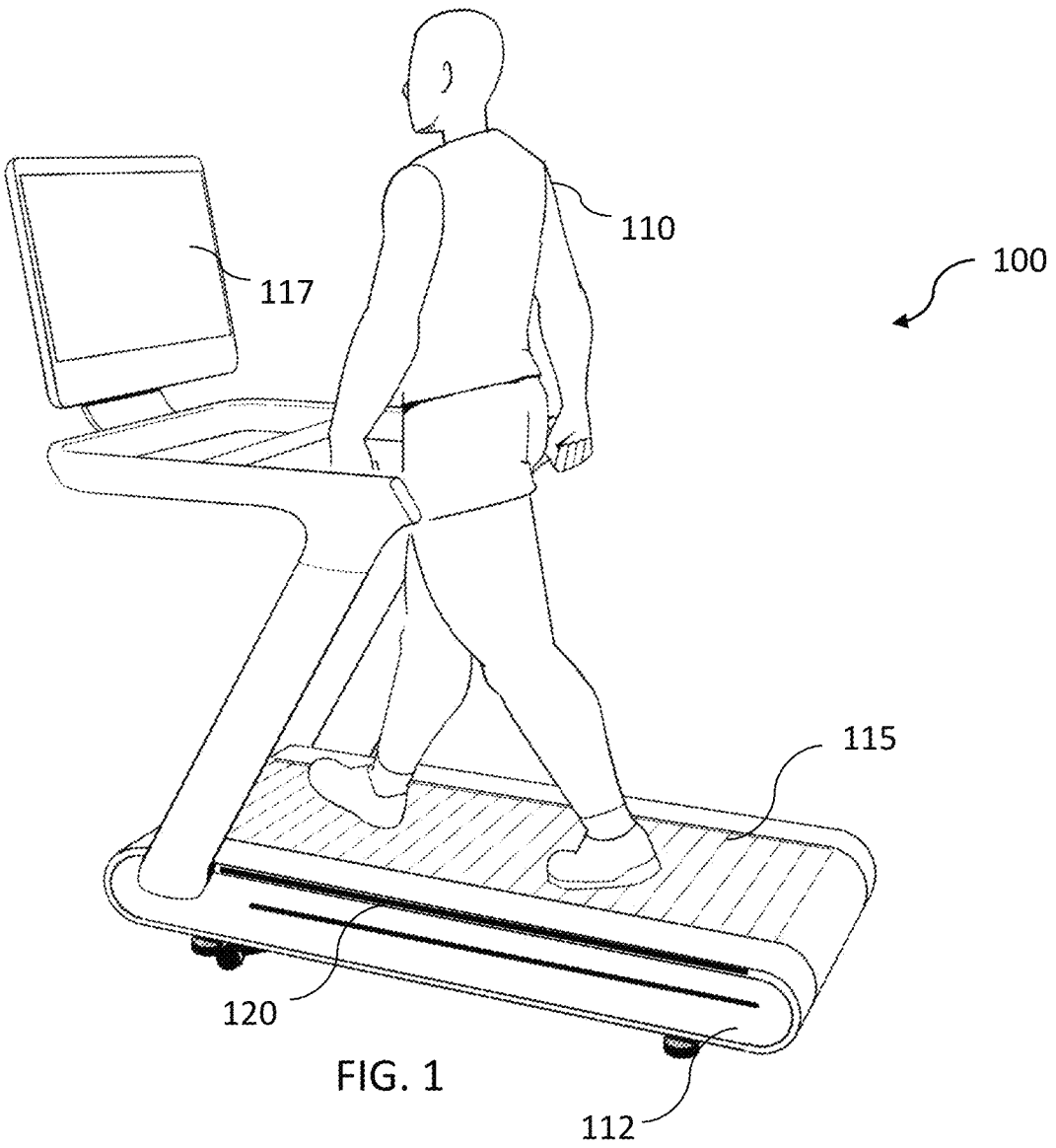
FIG. 1 is a diagram illustrating a cushioned treadmill.

In the drawings, some components are not drawn to scale, and some components and/or operations can be separated into different blocks or combined into a single block for discussion of some of the implementations of the present technology. Moreover, while the technology is amenable to various modifications and alternative forms, specific implementations have been shown by way of example in the drawings and are described in detail below. The intention, however, is not to limit the technology to the particular implementations described. On the contrary, the technology is intended to cover all modifications, equivalents, and alternatives falling within the scope of the technology as defined by the appended claims.

DETAILED DESCRIPTION

Overview

The devices, systems, methods, and apparatuses are directed to exercise machines, such as a treadmill or other exercise machine having a moving surface controlled by a motor. In some embodiments, the treadmill or exercise machine can include or incorporate various layers under the moving surface that provide cushioning or impact resilience for a user running/walking on the moving surface of the treadmill.

For example, a deck of the treadmill, upon which the moving surface moves around and over, can include or incorporate a cushioned layer disposed on the deck, along with a thermal layer and a wear layer. In some cases, the thermal layer is disposed on a top surface of the cushioning layer, and the wear layer is disposed on the thermal layer (e.g., between the thermal layer and the moving surface).

By utilizing both layers (e.g., a thermal and wear layer) with the cushioning layer, the treadmill can provide a cushioned surface upon which a user runs or walks that is protected from degradation due to resisting abrasion from the moving surface (e.g., via the wear layer) and by promoting or enhancing thermal dissipation (e.g., via the thermal layer), which can also degrade the moving surface or other components of the treadmill, among other benefits.

Of course, in addition to treadmills and other exercise machines, the technology described herein can be implemented in any apparatus that includes or can be enhanced by a cushioned surface below a moving surface, such as a belt, moving walkway or other conveyor (e.g., a travelator), and so on.

Various embodiments of the apparatuses, devices, systems, assemblies, and methods will now be described. The following description provides specific details for a thorough understanding and an enabling description of these embodiments. One skilled in the art will understand, however, that these embodiments may be practiced without many of these details. Additionally, some well-known structures or functions may not be shown or described in detail, so as to avoid unnecessarily obscuring the relevant description of the various embodiments. The terminology used in the description presented below is intended to be interpreted in its broadest reasonable manner, even though it is being used in conjunction with a detailed description of certain specific embodiments.

Examples of a Treadmill Having a Cushioned Deck

In some embodiments, a cushioning assembly, such as one or more layers that provide a user with cushioned footfalls, is attached or otherwise fixed to a treadmill, such as to a top surface of a deck of the treadmill. The cushioning assembly, as described herein, enables the treadmill to provide a cushioned surface or platform upon which the user runs, jogs, walks, and so on, when the treadmill is in operation.

FIG. 1 is a diagram illustrating a treadmill 100 having a cushioned deck. A runner 110 is running/walking on a moving surface 115 (e.g., a belt or slat-based surface) that moves or travels around a deck 112 of the treadmill 100. The runner 110 may be running or walking as part of a workout guided by the treadmill (e.g., a class presented by a display 117 of the treadmill) and/or running/walking without any guidance and maintaining their own pace or workout parameters.

A cushioning assembly 120 is disposed or placed onto a top surface of the deck 112. The cushioning assembly 120, as described herein, can include one or more multiple layers that provide a cushioned surface, such as a surface that is softer (to the user) than the top surface of the deck 112. In some cases, the cushioning assembly 120 covers or extends to cover an entire top surface of the deck 112. In other cases, the cushioning assembly 120 covers a portion or section of the top surface of the deck 112, such as a center section upon which the runner 110 contacts the deck 112 when running or walking.

Figure 2:
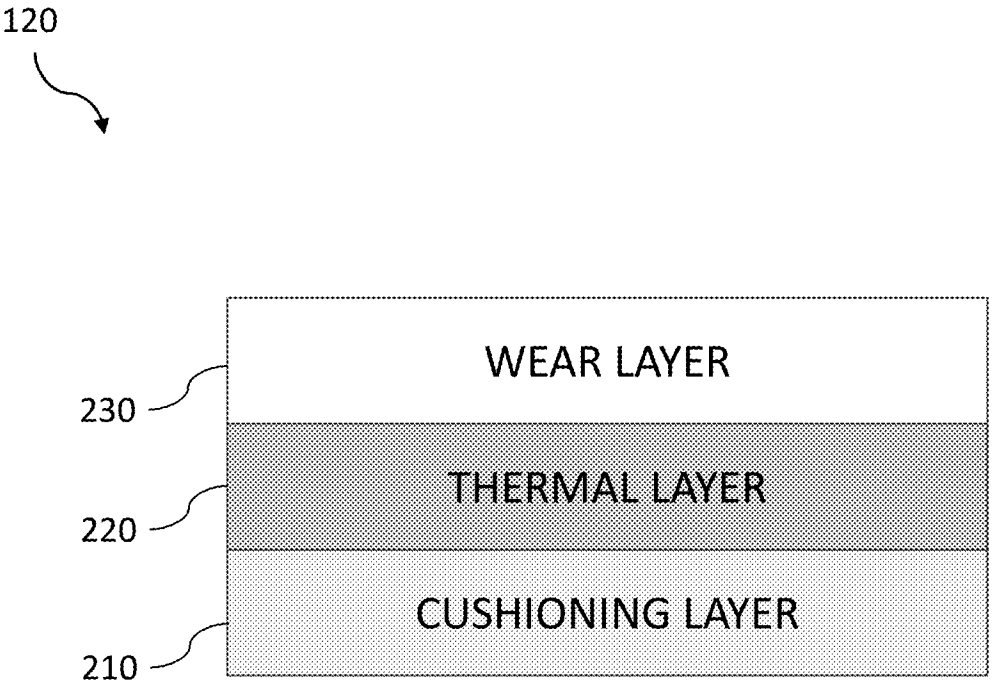
FIG. 2 is a diagram illustrating layers of a deck of a treadmill.

FIG. 2 is a diagram illustrating layers of a deck of a treadmill, such as the layers of the cushioning assembly 120. A cushioning layer 210 is disposed onto a top surface of the deck 112, such as a rigid surface that comprises fiberboard (e.g., medium density fiberboard (MDF) and/or high density fiberboard (HDF). The cushioning layer 210 can be made from or formed of polyurethane foam or other cushioning materials.

A thermal layer 220 is disposed or placed on top of the cushioning layer 210. The thermal layer 220 can be made from or formed of metal flashing or mesh layer. The thermal layer and acts to aid or assist in thermal dissipation (e.g., due to heat generated by direct pressure between the moving surface 115 and the deck 112) throughout the cushioning assembly 120. Thus, the use of the thermal layer 220 may prevent or mitigate degradation of the other layers of the cushioning assembly 120 during operation of the treadmill.

On top of the thermal layer 220 is a wear layer 230 (or outer protective layer). The wear layer 230 can be formed of acetal, PEEK (polyetheretherketone) material or other similar resistive films, such as engineering thermoplastics, which function to resist the wearing of the lower layers due to contact with a moving belt above the cushioning assembly 120. Thus, in some cases, the wear layer 230 is a protective top surface of the cushioning assembly 120 when the moving belt or running surface contacts the assembly 120 during operation or use of the treadmill 100.

In some embodiments, the cushioning assembly 120 can include other configurations or geometries of the layers shown in FIG. 2, as well as certain thicknesses, or relative thickness, of the layers.

Figure 3B:
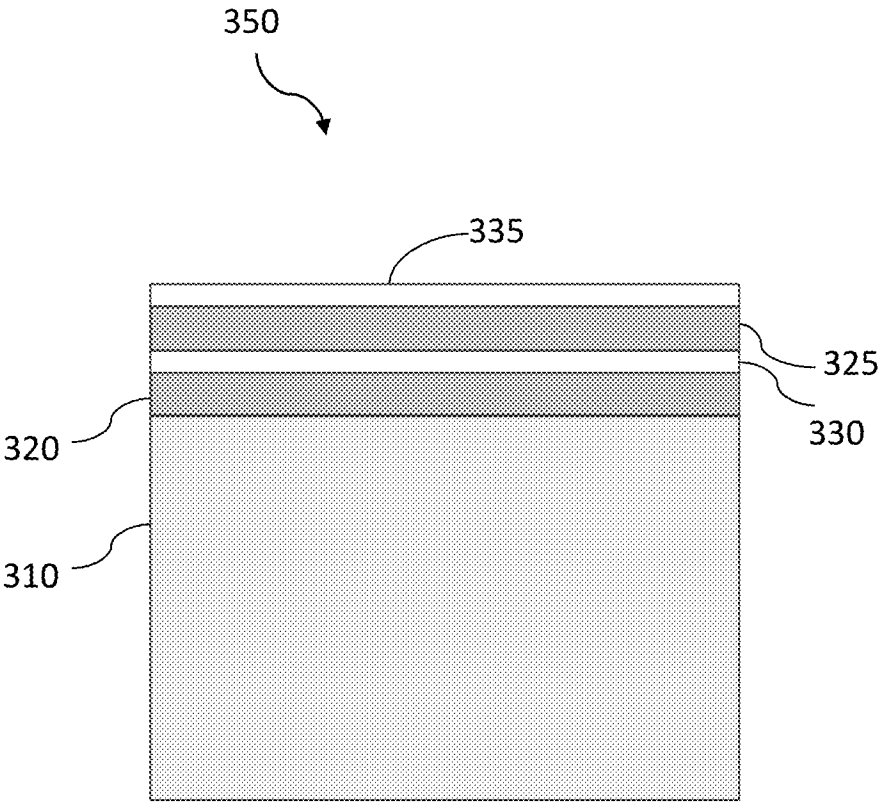
FIGS. 3A-3C are diagrams illustrating different layer configurations.
Figure 3A:
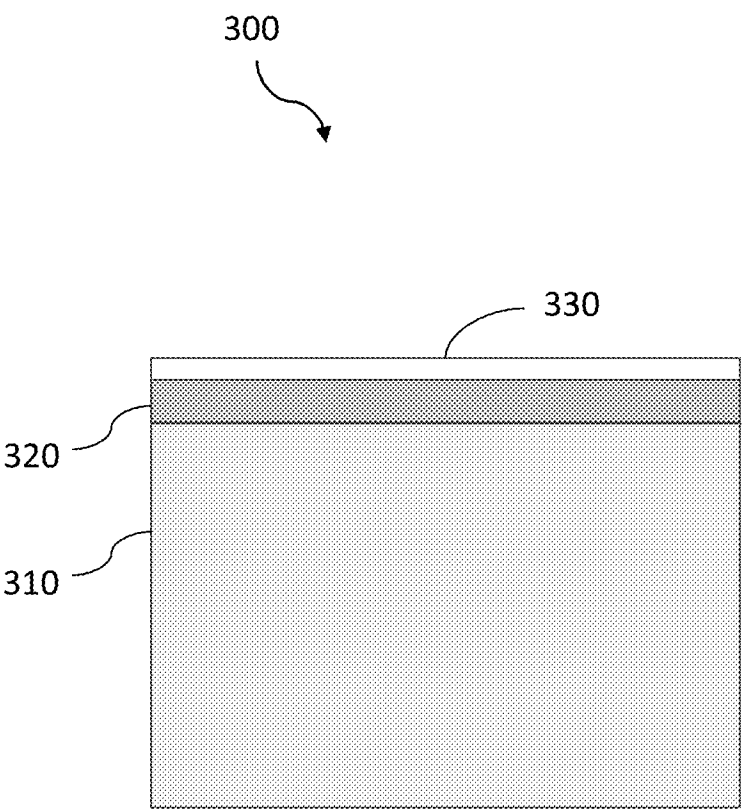

FIG. 3A depicts a cushioning assembly 300 and relative thicknesses between the layers. As depicted (although not to scale), a cushioning layer 310 is much thicker than a thermal layer 320 or a wear layer 330. Thus, the cushioning assembly 300 may include a certain thickness or overall height to provide sufficient cushioning, reliability, and/or durability, while also fitting within a small gap or opening between a moving surface and a deck of a treadmill. As an example, the cushioning assembly 300 may include:

- a rigid base (e.g., a top surface of the deck 112) that is formed of medium density fiberboard (MDF);
- a cushioning layer (e.g., the cushioning layer 310) that is formed of polyurethane foam or a similar polymer, having a thickness between 0.2 and 0.4 inches, such as a thickness of approximately 0.375 inches;
- a thermal layer (e.g., the thermal layer 320) that is formed of metal flashing and has a thickness that is less than or equal to 0.001 inches;
- a wear layer (e.g., the wear layer 330) that is formed of acetal or PEEK material and has a thickness that is approximately 0.005 inches.

Thus, in some embodiments, the cushioning assembly 300 can have a total thickness or height that is between 0.25 and 0.5 inches (e.g., between 0.35 and 0.40 inches), such as a combination of the cushioning layer 210 thickness being 0.375 inches and the remaining thickness being between 0.005 and 0.006 inches.

FIG. 3B depicts a cushioning assembly 350 that includes two or more cushioning layers, each separated by a thermal layer and/or all separated from a wear layer by the thermal layer. The cushioning assembly 350 includes the cushioning layer 310, the thermal layer 320, a second cushioning layer 325, a second thermal layer 325, the wear layer 330, and a wear layer 335.

Figure 3C:
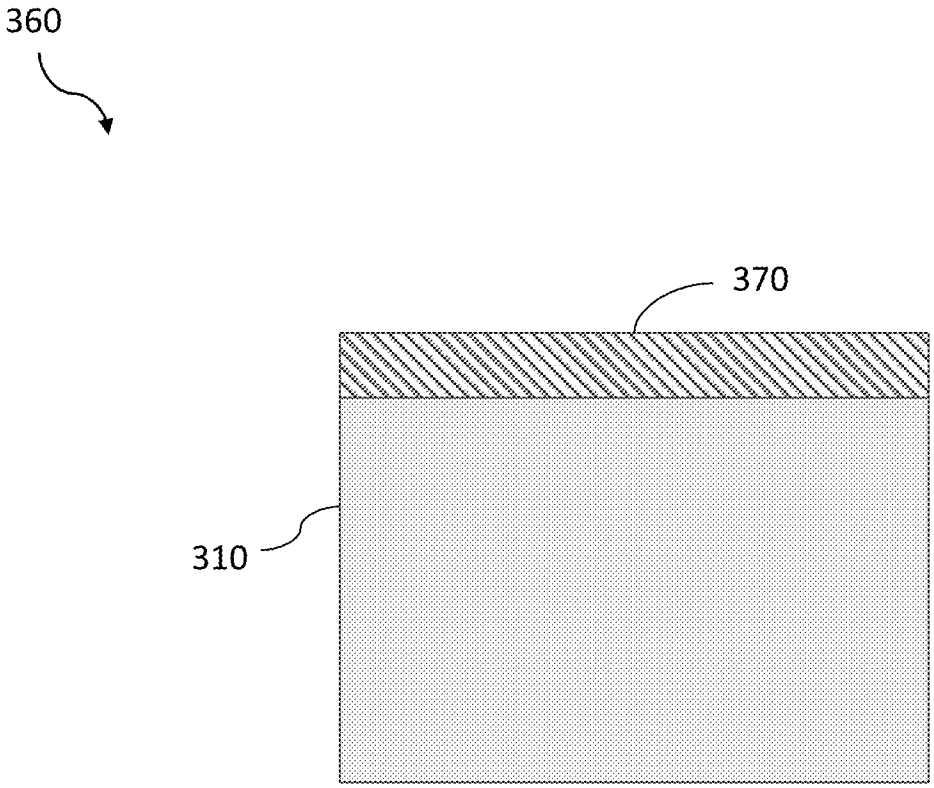

Further, a top layer may be a material or composite that provides both wear and thermal resistance or protection, protecting any cushioning layers from degradation due to mechanical abrasion from a moving surface and heat generated during use of the treadmill 110. FIG. 3C depicts a cushioning assembly 360 with a single protective layer 370. The single protective layer 370 may include materials (e.g., PEEK) that resist wear when contacted by the moving surface, as well as materials (e.g., metal flashing) that promote thermal dissipation during use of the treadmill.

As described herein, the cushioning assembly 120 may be disposed or applied to a top surface of the deck 112 of the treadmill in a variety of configurations and/or geometries. For example, in order to reduce an amount of material used to provide the cushioned experience, the cushioning assembly 120 may be placed under a moving surface where all, or most, of a runner's foot falls occur when performing a workout.

Figure 4A:
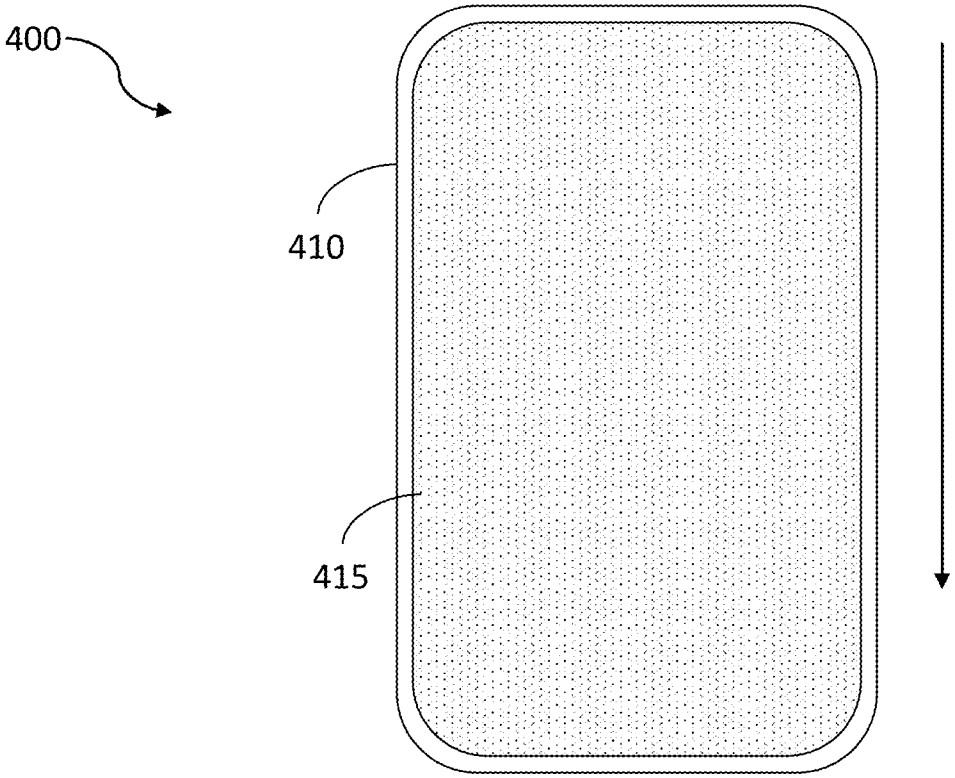
FIGS. 4A-4B are diagrams illustrating a top view of a cushioned treadmill.
Figure 4B:
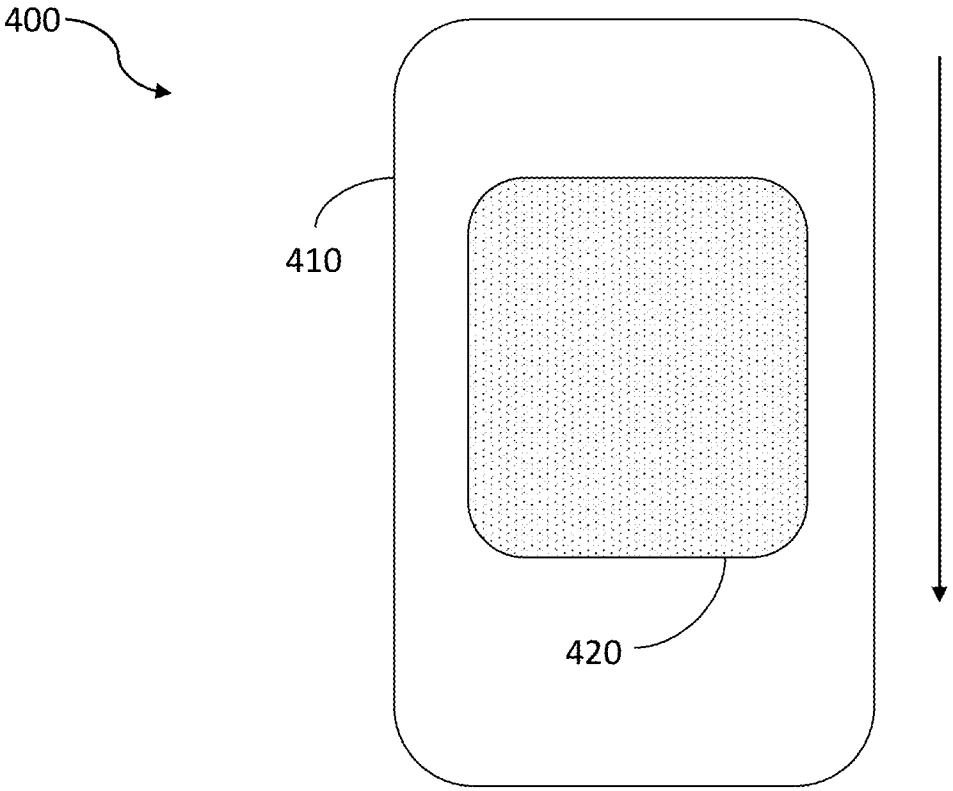

FIGS. 4A-4B are diagrams illustrating a top view of a cushioned treadmill. FIG. 4A depicts a treadmill 400 having a deck 410 and a cushioning assembly 415 disposed on top of the deck 410 and covering approximately an entire top surface of the deck 410.

FIG. 4B depicts a different configuration of the treadmill, where a cushioning assembly 420 is disposed on the deck 410 and covers a center section, or center area, of the deck 410. For example, the cushioning assembly 420 may be disposed on a section or area upon which a user runs or walks and is not disposed on other areas of the deck 410. The treadmill 400 may incorporate different shapes or geometries based on manufacturing efficiencies, manufacturing costs, and so on.

Figure 5:
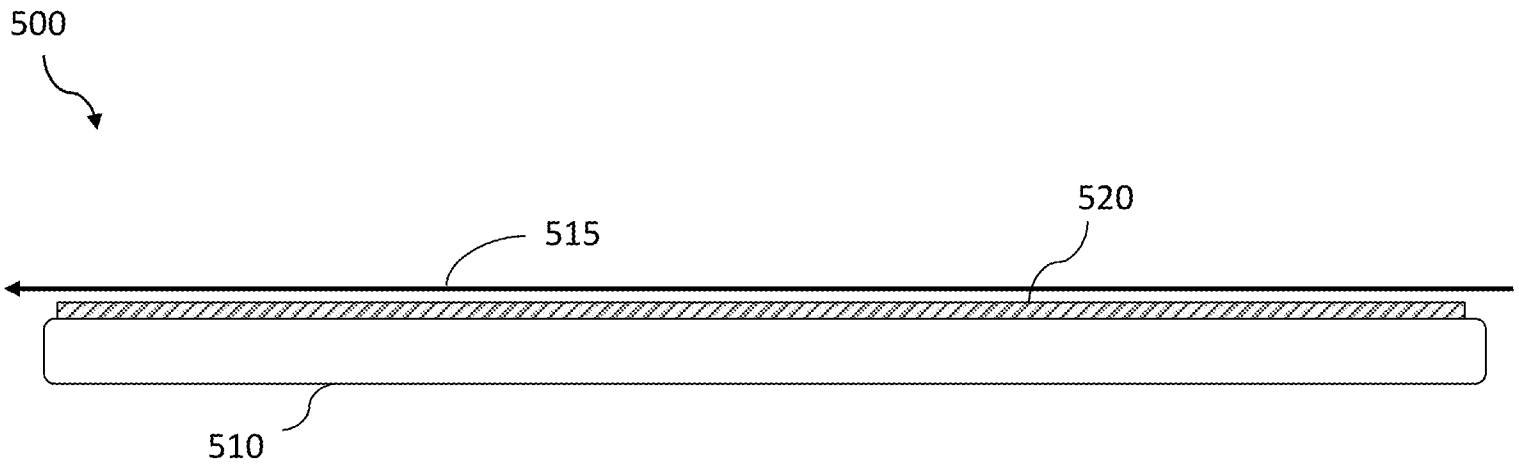
FIG. 5 is a diagram illustrating a cushioned walkway.

As described herein, the cushioning assemblies described herein may be incorporated into treadmills and other machines or apparatuses that provide a moving surface upon which a person walks or runs. FIG. 5 depicts a moving walkway 500 that incorporates a cushioning assembly 520 disposed onto a base structure 510 and under a moving surface 520, which moves in a horizontal direction. Of course, other walkways, such as those that move in two dimensions and/or over steps or other increments, can incorporate the technology described herein.

CONCLUSION

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or", in reference to a list of two or more items, covers all of the following interpretations of the word: any of the items in the list, all of the items in the list, and any combination of the items in the list.

The above detailed description of embodiments of the disclosure is not intended to be exhaustive or to limit the teachings to the precise form disclosed above. While specific embodiments of, and examples for, the disclosure are described above for illustrative purposes, various equivalent modifications are possible within the scope of the disclosure, as those skilled in the relevant art will recognize.

The teachings of the disclosure provided herein can be applied to other systems, not necessarily the system described above. The elements and acts of the various embodiments described above can be combined to provide further embodiments.

Any patents and applications and other references noted above, including any that may be listed in accompanying filing papers, are incorporated herein by reference. Aspects of the disclosure can be modified, if necessary, to employ the systems, functions, and concepts of the various references described above to provide yet further embodiments of the disclosure.

These and other changes can be made to the disclosure in light of the above Detailed Description. While the above description describes certain embodiments of the disclosure, and describes the best mode contemplated, no matter how detailed the above appears in text, the teachings can be practiced in many ways. Details of the technology may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features, or aspects of the disclosure with which that terminology is associated. In general, the terms used in the following claims should not be construed to limit the disclosure to the specific embodiments disclosed in the specification, unless the above Detailed Description section explicitly defines such terms. Accordingly, the actual scope of the disclosure encompasses not only the disclosed embodiments, but also all equivalent ways of practicing or implementing the disclosure under the claims.

From the foregoing, it will be appreciated that specific embodiments have been described herein for purposes of illustration, but that various modifications may be made without deviating from the spirit and scope of the embodiments. Accordingly, the embodiments are not limited except as by the appended claims.

What is claimed is:

1. A deck for a treadmill, the deck comprising:
a rigid base;
a cushioning layer that is disposed on a top surface of the rigid base; and
a protective layer that prevents degradation of the cushioning layer from mechanical abrasion and heat during operation of the treadmill,
wherein the protective layer is formed of polyetheretherketone and metal flashing.

2. The deck of claim 1, further comprising:
a second cushioning layer that is disposed on the protective layer.

3. The deck of claim 2, further comprising:
a second protective layer that is disposed on the second cushioning layer.

4. The deck of claim 1, wherein the protective layer includes a thermal layer and a wear layer.

5. The deck of claim 1, wherein the cushioning layer has a thickness of approximately 0.375 inches and the protective layer has a thickness between 0.005 and 0.006 inches.

6. The deck of claim 1, wherein the protective layer is disposed on a top surface of the cushioning layer.

7. The deck of claim 1, wherein the cushioning layer is disposed on a center section of the top surface of the rigid base.

8. A treadmill, comprising:
a moving surface; and
a deck around which the moving surface moves, the deck including:
a rigid base having a top surface and formed of fiberboard;
a cushioning layer disposed on the top surface of the rigid base and formed of polyurethane foam;
a thermal layer disposed on the cushioning layer and formed of metal flashing; and
a wear layer disposed on the thermal layer and formed of acetal.

9. The treadmill of claim 8, wherein the cushioning layer has a thickness of 0.375 inches and a thickness of a combination of the wear layer and the thermal layer is between 0.005 and 0.006 inches.

10. The treadmill of claim 8, wherein a thickness of a combination of the cushioning layer, the wear layer, and the thermal layer is between 0.35 and 0.40 inches.

11. The treadmill of claim 8, wherein the moving surface is a belt that moves over the top surface of the deck.

12. The treadmill of claim 8, wherein the moving surface is a slat-based surface that moves over the top surface of the deck.

13. An apparatus, comprising:
a moving surface; and
a rigid base over which the moving surface travels, the rigid base including:
a cushioning layer disposed on a top surface of the rigid base;
a thermal layer disposed on the cushioning layer; and
a wear layer disposed on the thermal layer,
wherein a thickness of a combination of the cushioning layer, the wear layer, and the thermal layer is between 0.35 and 0.40 inches.

14. The apparatus of claim 13, wherein the apparatus is a moving walkway, and wherein the moving surface is a belt that moves over the rigid base of the moving walkway.

15. The apparatus of claim 13, wherein the apparatus is a treadmill, and wherein the moving surface is a belt that moves around the rigid base of a moving walkway.

16. The apparatus of claim 13, wherein the cushioning layer, the wear layer, and the thermal layer are disposed on a center section of the top surface of the rigid base.

* * * * *